United States Patent [19]

Harley

[11] Patent Number: 5,028,189

[45] Date of Patent: Jul. 2, 1991

[54] ADJUSTABLE FIXING DEVICE

[75] Inventor: David N. Harley, Bournemouth, England

[73] Assignee: Titus Tool Company Limited, Buckinghamshire, England

[21] Appl. No.: 396,502

[22] Filed: Aug. 21, 1989

[30] Foreign Application Priority Data

Aug. 26, 1988 [GB] United Kingdom ..... 8820370

[51] Int. Cl.[5] ..... F16B 39/28

[52] U.S. Cl. ..... 411/108; 411/112; 411/113; 411/182; 411/432

[58] Field of Search ..... 411/180, 182, 432, 112, 411/2-5, 113, 108, 103, 39-43

[56] References Cited

U.S. PATENT DOCUMENTS

| | | | |
|---|---|---|---|
| 1,808,318 | 6/1931 | Pleister | 411/41 |
| 2,102,230 | 12/1937 | Waterman | 411/41 |
| 3,130,765 | 4/1964 | Neuschotz | 411/108 |
| 3,216,304 | 11/1965 | James et al. | 411/40 |
| 3,640,327 | 2/1972 | Burt | 411/108 |
| 3,646,982 | 3/1972 | Cushman | 411/108 X |
| 4,143,579 | 3/1979 | Ziaylek, Jr. | 411/42 |
| 4,307,986 | 12/1981 | Barnsdale | 411/41 |

FOREIGN PATENT DOCUMENTS

| | | | |
|---|---|---|---|
| 833113 | 3/1952 | Fed. Rep. of Germany | 411/44 |
| 3146995 | 6/1983 | Fed. Rep. of Germany | 411/42 |

*Primary Examiner*—Lloyd A. Gall

*Attorney, Agent, or Firm*—Lowe, Price, LeBlanc and Becker

[57] ABSTRACT

A device suitable for use in firmly fixing one member (10), to another member (12) in a relatively adjustable position, comprising a retaining part (2) fixable to said one member and a retained part (4) in use retained by, yet movable relative to, said retaining part, the retained part being adapted to be secured to the other member and to become substantially immovable relative to the retaining part when said securement is tightened, characterized in that the retained and retaining parts are formed as one piece but are breakable apart (6) to permit said relative movement.

5 Claims, 2 Drawing Sheets

ADJUSTABLE FIXING DEVICE

BACKGROUND OF THE INVENTION

1. Field of the Invention

This invention relates to devices suitable for use in firmly fixing one member to another member in an adjustable position and particularly, but not exclusively, to devices for fixing decorative or finishing furniture panels to basic furniture components such as for example fixing styled drawer fronts to basic drawer boxes as is usually required in finishing modern kitchen, bedroom and other furniture so as to enable precise alignment of the various styled panels relative to each other despite slight tolerances in the alignment of the basic units.

2. Description of the Prior Art

Devices of this general kind are known, which are in the form of a plug fitted into a socket in the rear of the styled panel. The styled panel is then positioned in front of, for example, a drawer box to which it is to be fitted, a screw is inserted through a bore from the inside of the drawer box and into the rear of the plug and partially tightened into the fixing device. In this partially tightened condition, the styled panel can be moved into its properly aligned position and pre-located there. Once two more such devices have been partially tightened in this way and the alignment completed, the screws of all of them are tightened to complete the fixing of the styled panel in its proper position.

A type of fixing device used in this way consists of a substantially hollow outer plastics plug which is manufactured in an open condition. A metal nut having laterally extending wings is then located within the plug, which is then closed around the nut to complete the fixing device. When the device is being used, the metal nut is movable relative to and within the plug and this is what allows adjustment of the position of the styled panel after the screw has been partly tightened into the metal nut but before tightening has been completed. The process of manufacturing and then assembling the parts for a device of this type is, however, relatively time-consuming and expensive.

An object of the invention is to provide an improved and less costly type of fixing device of the general kind discussed above.

The invention provides a device suitable for use in firmly fixing one member to another member in an adjustable position, comprising a retaining part fixable to said one member and a retained part in use retained by, yet movable relative to, said retaining part, the retained part being adapted to be secured to the other member and to become substantially immovable relative to the retaining part when said securement is tightened, characterized in that the retained and retaining parts are formed as one piece but are breakable apart to permit said relative movement.

Preferably, as in the preferred embodiment described below, the device is arranged such that the process of fixing the retaining part to said one member causes said parts to break apart. In particular, the retaining part may be in the form of a plug to fit into a matching blind socket in said one member and the retained part may be accessible at the leading end of the plug, preferably protruding therefrom, so that as the plug enters the socket the retained part is the first to be pressed against the bottom of the socket and is thus pressed into and broken away from the retaining part so as to automatically achieve the relatively movable condition needed when the fixing device is thereafter being used in the formation of an aligned and tightened fixture.

By forming the retained and retaining parts as a single piece, which can be done in a one-shot molding operation in plastics material, the cost of manufacturing the device is reduced since only one component has to be made and no assembly steps are required.

BRIEF DESCRIPTION OF THE DRAWING

In order that the invention may be more clearly understood a preferred embodiment thereof will now be described, by way of example, with reference to the accompanying drawings in which.

DESCRIPTION OF THE PREFERRED EMBODIMENTS

Figure 1:
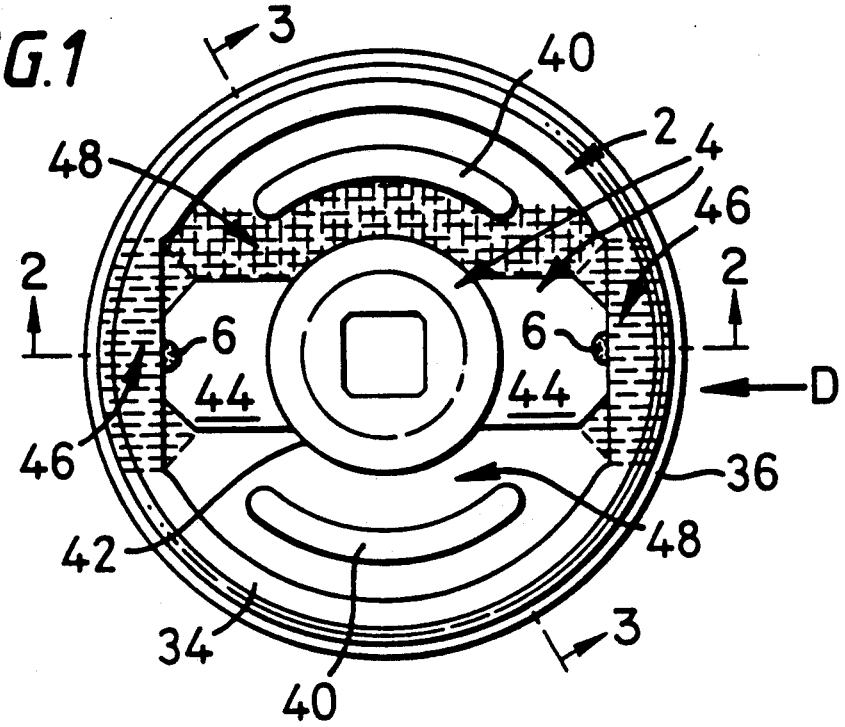
FIG. 1 shows a plan view of a fixing device in accordance with the invention seen from direction A in FIG. 2.

The device, according to a preferred embodiment of this invention although formed in one piece by injection molding from plastics material, comprises two main parts, namely, a retaining part in the form of a plug 2 and a retained part in the form of a nut 4. Perhaps FIG. 2 shows most clearly how the nut 4 is located inside the housing 2 and is linked to it integrally by two very small approximately quarter-spherical portions 6 which can also be seen in FIG. 1.

Before further describing the constructional features of the device the way in which it is to be used will be described with reference to FIG. 2 which shows in broken lines part of, for example, a styled drawer front 10 which is to be fixed to the front panel 12 of a drawer box.

The rear side of the drawer front 10 is formed with a blind socket 14 of a diameter matching that of the fixing device so that the latter can be pushed normally by automatic assembly machinery into the socket in the opposite direction from arrow A.

Figure 2:
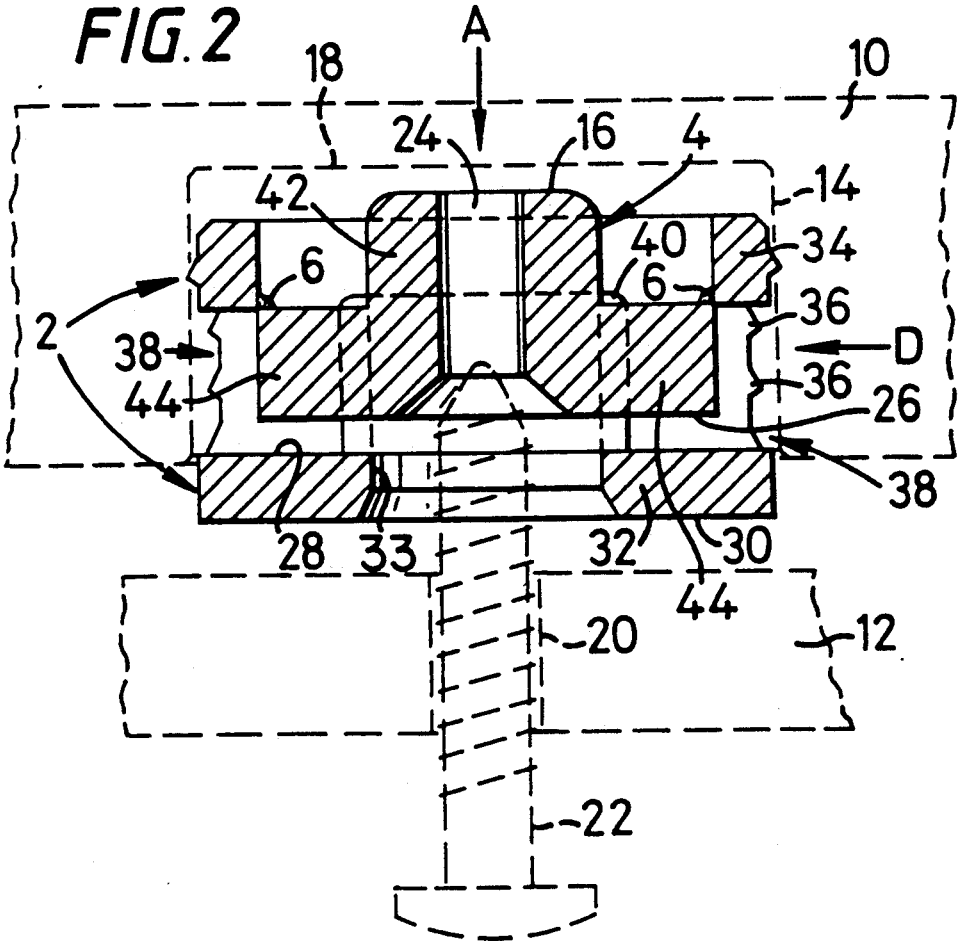
FIG. 2 is a cross-section through the device of FIG. 1 on line 2—2, showing also in broken lines the two members to be fixed together and the screw used in achieving this.
Figure 3:
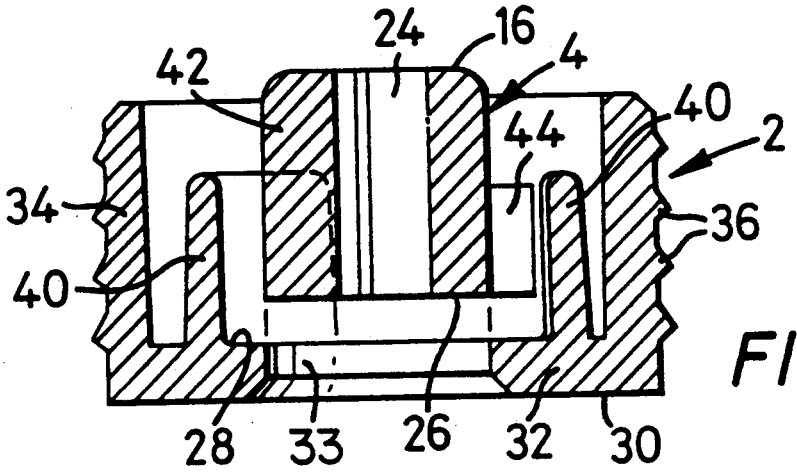
FIG. 3 is a cross-section taken on the line 3—3 in FIG. 1.

FIG. 2 shows the device almost fully inserted. As insertion continues from the position shown, the leading end 16 of the nut 4 will contact the bottom 18 of the socket and further insertion movement will cause the breakable portions 6 to break as the nut 4 remains stationary and the remainder of the device continues into its fully inserted position. In this condition, the nut is free to move to a limited extent in all directions inside the retaining body 2.

The styled panel 10 is brought into position with the fixing device opposite a hole 20 bored in the drawer box front 12. A screw 22 is then inserted through hole 20 and is screwed into a square hole 24 in the center of the nut 4, this continuing until the surface 26 of the nut is brought into contact with the inside surface 28 of the trailing end of the plug. The outside surface 30 of the plug will at this time be in contact with the drawer front 12 so that there will be some frictional engagement between surfaces 26 and 28.

In this condition the styled panel 10 can be shifted to a limited degree from left to right and perpendicular to the drawing as viewed in FIG. 2 so as to enable it to be brought into any desired alignment, within certain limits, relative to the drawer box front 12.

Once such alignment has been achieved (normally using more than one such fixing device for a single styled panel) tightening of the screw 22 is completed so that the surfaces 26 and 28 become clamped hard together and the parts 2 and 4 of the fixing device and hence the panels 10 and 12, become substantially immovable relative to each other.

Reference will now be made to some of the more detailed features of the fixing device shown in the figures.

The housing or retaining part 2 is basically cup-shaped having an annular bottom wall 32 in which is central opening 33 to give the screw 22 access to the nut 4. The diameter of the opening 33 in conjunction with the diameter of the screw limits the amount of lateral movement available when the device is in the pre-tightened condition. Around the periphery of the bottom wall 32 is an annular side wall 34 formed with external ribs 36 which provide a firm grip between the device and the wall of the socket 14 which it is inserted into.

Figure 4:
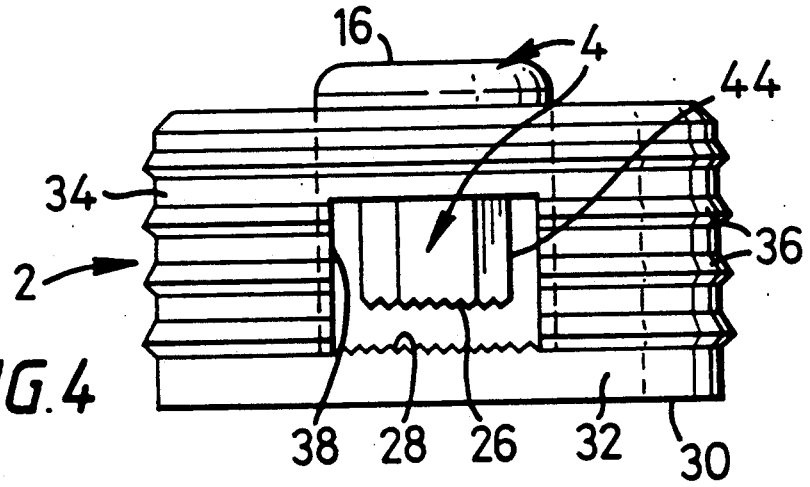
FIG. 4 is a side elevation taken in the direction of arrows D in FIGS. 1 and 2.
Figure 5:
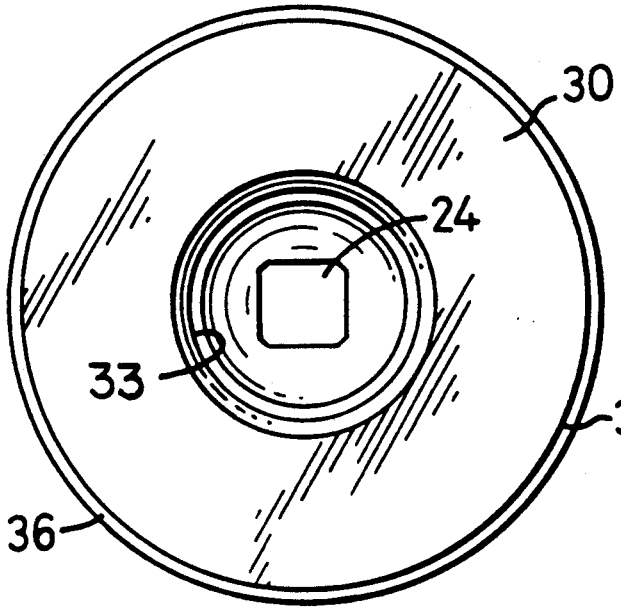
FIG. 5 is a plan view of the device from a direction opposite to that of arrow A in FIG. 2.

The annular side wall 34 is formed with two diametrically opposed rectangular openings 38 seen most easily in FIGS. 2 and 4.

Within the body or retaining part 2 and formed integrally with it there are two upstanding arcuate protrusions 40 which co-operate with parts of the nut 4, as will be further described, to limit the extent to which it can rotate in either direction relative to the housing 2 when the screw 22 is being tightened or loosened.

Turning now to the nut 4, its central part is a generally cylindrical boss 42, from which project two opposed lateral extensions 44, on which are located the frangible portions 6 previously referred to for joining the nut to the housing. It can be seen from FIG. 1 that the ends of lateral extensions 44 are chamfered on each corner and it will be appreciated that FIG. 4 shows an elevation view of one of these chamfered ends through the aperture 38 in the side wall 34. Rotation of the nut 4 relative to the housing 12 is limited by the sides of extensions 44 contacting the ends of arcuate protrusions 40.

For the purpose of molding the device illustrated, four cores enter into the basic mold cavity. One core enters in the direction of arrow A in FIG. 2, another in the opposite direction, and two other cores come in from the sides of the mold in direction D and in the opposite direction, respectively. It will be appreciated from a study of the drawings that these four cores can form all the surfaces required internally to define the nut 4 frangibly supported within the housing 2.

It has been mentioned that a degree of friction is present between the surfaces 26 and 28 to facilitate pre-positioning of the components of the device before it is tightened, and substantial friction at this point is required to render it substantially immovable after tightening. For that purpose, both of these surfaces are given a roughened configuraton. This takes the form of ribs or splines on surface 28 in the areas generally indicated at 46 in FIG. 1 (in broken lines mainly since these areas are primarily within the openings 38 and therefore obscured in FIG. 1) and also in the area which is obscured by the two lateral extensions 44 in FIG. 1. The surface configuration needs to be in line form in those areas since they have to be formed by the mold cores which enter laterally in direction D and the opposite direction. In the areas 48 (FIG. 1) the surface 28 is formed with a pattern of tiny cones (indicated only diagrammatically and only in the top half of FIG. 1) to provide deliberate roughening of surface 28 thereat.

The opposed surface 26 on the nut 4 is formed with ribs or splines similar to those in the area 46, again by corresponding formations on the mold cores which enter from direction D and the opposite direction.

These configurations of surfaces 26 and 28 are shown in exaggerated form in FIG. 4 and they facilitate adjustment of the fixing device when it is only partially tightened, by providing a useful ratcheting or clicking action when the two parts of the device are shifted relative to each other. They also provide a degree of physical engagement which makes the joint particularly firm and immovable once the screw 22 has been fully tightened.

It is envisaged that, instead of the leading end 16 of the nut 4 protruding beyond the leading end of the housing 2, it could in fact lie within that leading end so that the nut would not automatically become detached from the housing upon insertion of the plug into its socket. The breaking of the two parts from each other would then be achieved by a firm tap on the end of screw 22, so as to drive the nut 4 forwards and break the fillets 6. The nut 4 would then be drawn backwards again as the screw was tightened. Alternatively, an arrangement could be devised whereby the readily frangible portion was between the nut and the inside of the trailing end of the housing 2, rather than between the nut and the inside of the leading end of the housing 2 as illustrated.

Still other objects and advantages of the present invention will become readily apparent to those skilled in this art from the preceding detailed description wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive, the invention being defined solely by the claims appended hereto.

I claim:

1. A device suitable for use in firmly fixing a first member to a second member in a selected position relative thereto, comprising:

a retaining part fixable to said first member; and a retained part adapted to be secured to said second member and in use to be retained by, yet movable relative to said retaining part, the device being adapted to cooperate with a tightening element operable to draw the retained part and the retaining part together in a first direction, the relative movement being in a plane generally perpendicular to said first direction, wherein the retained part is adapted to become substantially immovable in a position selected relative to the retaining part when the tightening element is tightened, said retained and retaining parts being formed as one piece, but being breakable apart to permit said relative movement therebetween, wherein affixation of the retaining part to said first member causes said retained and retaining parts to break apart, the retaining part is in the form of a plug to fit into a matching blind socket in said first member, the plug having a leading end for insertion in the socket and a trailing end, and the retained part is in the form of a nut located within the plug and having a hole for entry of a screw for securing the nut to the second member and drawing it tightly against an inner surface of the plug at said plane of relative movement at the trailing end of the plug.

2. A device as claimed in claim 1, wherein:

the trailing end of the plug has an opening for allowing entry of the screw into the hole, the relative movement of the two parts before tightening being limited in accordance with the size of the opening and the diameter of the screw.

3. A device as claimed in claim 1, wherein:

the nut has one or more lateral extensions which bear upon an inner surface of the trailing end of the plug upon tightening.

4. A device as claimed in claim 3, wherein:

the plug is formed with one or more internal protrusions which co-operate with the one or more lateral extensions on the nut to limit relative rotation of the nut and plug.

5. A device as claimed in claim 1, wherein:

the nut is linked by a link to an inner surface of the leading and of the plug to form a single piece, and the link comprise at least one frangible portion thereof which when broken allows the nut to move towards the trailing end of the plug.

* * * * *